US009353924B2

(12) United States Patent
Scarlata et al.

(10) Patent No.: US 9,353,924 B2
(45) Date of Patent: May 31, 2016

(54) ASSEMBLY SYSTEMS FOR MODULAR LIGHT FIXTURES

(71) Applicants: Andrew Francis Scarlata, West Monroe, NY (US); Graig Edmund DeCarr, Cicero, NY (US)

(72) Inventors: Andrew Francis Scarlata, West Monroe, NY (US); Graig Edmund DeCarr, Cicero, NY (US)

(73) Assignee: Cooper Technologies Company, Houston, TX (US)

( * ) Notice: Subject to any disclaimer, the term of this patent is extended or adjusted under 35 U.S.C. 154(b) by 78 days.

(21) Appl. No.: 14/152,581

(22) Filed: Jan. 10, 2014

(65) Prior Publication Data

US 2015/0198298 A1 Jul. 16, 2015

(51) Int. Cl.

| | |
|---|---|
| ***F21V 19/00*** | (2006.01) |
| ***F21V 21/30*** | (2006.01) |
| ***F21S 9/00*** | (2006.01) |
| ***F21S 2/00*** | (2016.01) |
| ***F21V 21/108*** | (2006.01) |
| ***F21V 21/116*** | (2006.01) |
| *F21Y 101/02* | (2006.01) |
| *F21Y 105/00* | (2016.01) |

(52) U.S. Cl.

CPC .. *F21S 9/00* (2013.01); *F21S 2/005* (2013.01); *F21V 19/003* (2013.01); *F21V 21/108* (2013.01); *F21V 21/116* (2013.01); *F21V 21/30* (2013.01); *F21Y 2101/02* (2013.01); *F21Y 2105/001* (2013.01)

(58) Field of Classification Search

CPC ..... F21S 2/005; F21V 19/003; F21V 29/507; F21V 21/30; F21V 15/01; F21V 15/015; F21W 2131/107; F21Y 2105/001

USPC ..... 362/238, 239, 249.01–249.03, 249.07, 362/249.09, 249.1, 249.11

See application file for complete search history.

(56) References Cited

U.S. PATENT DOCUMENTS

| | | | |
|---|---|---|---|
| D136,799 | S | 12/1943 | Vendope |
| 3,585,380 | A | 6/1971 | Friedman et al. |
| 3,619,602 | A | 11/1971 | Wilde |
| 6,065,854 | A | 5/2000 | West et al. |

(Continued)

FOREIGN PATENT DOCUMENTS

| | | |
|---|---|---|
| CN | 2906328 | 5/2007 |
| CN | 200965196 | 10/2007 |

(Continued)

OTHER PUBLICATIONS

Cooper Crouse-Hinds,"VMVIG and DMVIG Series Champ Induction Luminaires with Induction Lighting System", Product Brochure, Jun. 2005, pp. 1-8, Cooper Crouse-Hinds, USA.

(Continued)

*Primary Examiner* — Elmito Breval
*Assistant Examiner* — Steven Horikoshi
(74) *Attorney, Agent, or Firm* — King & Spalding LLP

(57) ABSTRACT

A light fixture is disclosed. The light fixture can include a first light module and a second light module, each having at least one coupling feature, a power source, and at least one electrical receiver providing access to the power source. The light fixture can also include at least one first bracket having a first portion and a second portion, where the first portion mechanically couples to the at least one first coupling feature of the first light module, and where the second portion mechanically couples to the at least one second coupling feature of the second light module.

16 Claims, 11 Drawing Sheets

(56) References Cited

U.S. PATENT DOCUMENTS

| | | | | |
|---|---|---|---|---|
| 6,095,671 | A | 8/2000 | Hutain | |
| 6,435,699 | B2 | 8/2002 | Glowach, Sr. et al. | |
| 6,659,622 | B2 | 12/2003 | Katogi et al. | |
| 6,731,077 | B1 | 5/2004 | Cheng | |
| 7,021,793 | B2 | 4/2006 | Biasoli et al. | |
| 7,524,089 | B2 | 4/2009 | Park | |
| 7,766,508 | B2 | 8/2010 | Villard et al. | |
| 7,780,318 | B2 | 8/2010 | Xiao et al. | |
| 7,789,530 | B2 | 9/2010 | Stein et al. | |
| D625,870 | S | 10/2010 | Feigenbaum | |
| 7,810,958 | B2 | 10/2010 | Liu et al. | |
| 7,828,465 | B2 | 11/2010 | Roberge et al. | |
| 7,832,897 | B2 | 11/2010 | Ku | |
| 7,854,534 | B2 | 12/2010 | Liu | |
| 7,918,591 | B2 | 4/2011 | Lynch | |
| D641,905 | S | 7/2011 | Janssen | |
| 7,993,033 | B2 | 8/2011 | Moriyama et al. | |
| D645,593 | S | 9/2011 | Janssen | |
| D645,594 | S | 9/2011 | Grawe | |
| 8,057,057 | B2 | 11/2011 | Park | |
| 8,066,403 | B2 | 11/2011 | Sanfilippo et al. | |
| D650,505 | S | 12/2011 | Oka | |
| 8,092,049 | B2 | 1/2012 | Kinnune et al. | |
| 8,115,395 | B2 | 2/2012 | Horng et al. | |
| D663,877 | S | 7/2012 | Quevy et al. | |
| D667,582 | S | 9/2012 | Toft | |
| 8,287,151 | B2 | 10/2012 | Chung et al. | |
| 8,292,449 | B2 | 10/2012 | Poissonnet et al. | |
| 8,408,739 | B2 | 4/2013 | Villard et al. | |
| 8,434,898 | B2 | 5/2013 | Sanfilippo et al. | |
| 8,455,901 | B2 | 6/2013 | Chan et al. | |
| 2002/0093820 | A1 | 7/2002 | Pederson | |
| 2003/0142499 | A1 | 7/2003 | Chiu | |
| 2006/0056169 | A1* | 3/2006 | Lodhie et al. | 362/97 |
| 2007/0195527 | A1* | 8/2007 | Russell | 362/240 |
| 2007/0242939 | A1* | 10/2007 | Cutler et al. | 396/62 |
| 2008/0062682 | A1 | 3/2008 | Hoelen et al. | |
| 2008/0310162 | A1 | 12/2008 | Thomas et al. | |
| 2009/0262533 | A1 | 10/2009 | Liu et al. | |
| 2009/0289160 | A1* | 11/2009 | Kludt | G09F 9/33 248/226.11 |
| 2009/0290354 | A1 | 11/2009 | Moriyama et al. | |
| 2010/0014289 | A1 | 1/2010 | Thomas et al. | |
| 2010/0232155 | A1* | 9/2010 | Wang | F21S 2/005 362/235 |
| 2010/0238655 | A1* | 9/2010 | Sloan et al. | 362/225 |
| 2010/0259935 | A1 | 10/2010 | Scordino et al. | |
| 2010/0328945 | A1* | 12/2010 | Song et al. | 362/240 |
| 2011/0013395 | A1 | 1/2011 | Melzner et al. | |
| 2011/0019416 | A1 | 1/2011 | Poissonnet et al. | |
| 2011/0068708 | A1 | 3/2011 | Coplin et al. | |
| 2011/0110081 | A1 | 5/2011 | Belknap et al. | |
| 2011/0141728 | A1 | 6/2011 | Russello et al. | |
| 2011/0235330 | A1 | 9/2011 | Pedersen et al. | |
| 2011/0242822 | A1 | 10/2011 | Rong et al. | |
| 2011/0249427 | A1 | 10/2011 | Rooms et al. | |
| 2011/0285292 | A1* | 11/2011 | Mollnow | F21S 10/02 315/113 |
| 2011/0292656 | A1 | 12/2011 | Saxena | |
| 2011/0309751 | A1 | 12/2011 | Ter-Hovhannisyan | |
| 2011/0317420 | A1 | 12/2011 | Jeon et al. | |
| 2012/0086340 | A1 | 4/2012 | Hashizume | |
| 2012/0127702 | A1 | 5/2012 | Lax et al. | |
| 2012/0170255 | A1 | 7/2012 | Mcmillan | |
| 2012/0176790 | A1 | 7/2012 | Kinnune et al. | |
| 2012/0218758 | A1 | 8/2012 | Wang et al. | |
| 2012/0230030 | A1 | 9/2012 | Miller et al. | |
| 2012/0243227 | A1* | 9/2012 | Shimizu et al. | 362/249.01 |
| 2012/0281409 | A1 | 11/2012 | Patkus et al. | |
| 2013/0077339 | A1 | 3/2013 | Moyer | |
| 2013/0083546 | A1 | 4/2013 | Duan et al. | |
| 2013/0088882 | A1 | 4/2013 | Guercio et al. | |
| 2013/0094226 | A1 | 4/2013 | Huang et al. | |
| 2013/0114262 | A1 | 5/2013 | McClellan | |
| 2013/0279172 | A1 | 10/2013 | Wang | |
| 2013/0279179 | A1 | 10/2013 | Pearson et al. | |

FOREIGN PATENT DOCUMENTS

| | | |
|---|---|---|
| CN | 201615398 | 10/2010 |
| CN | 101761801 | 8/2011 |
| CN | 202852608 | 4/2013 |
| JP | 13048026 | 3/2013 |
| KR | 20-2008-0000034 | 1/2008 |
| KR | 20-0447539 | 2/2010 |
| KR | 100945420 | 8/2010 |
| KR | 10-0997746 | 12/2010 |
| RU | 54136 U1 | 6/2006 |

OTHER PUBLICATIONS

Cooper Crouse-Hinds, "Flood Light Fixtures", Product Brochure, 2001, pp. 1-12, Cooper Crouse-Hinds, USA.

Kim, Kapbyung, Korean Intellectual Property Office, International Search Report and Written Opinion issued in international application No. PCT/US2012/031595, Oct. 26, 2012, 8 pages, Korean Intellectual Property Office.

T. Vladimirova and S. Surikov, Federal Institute of Industrial Property, International Search Report and Written Opinion issued in international application No. PCT/US 2015/010682, completed Apr. 10, 2015, mailed Apr. 16, 2015, 7 pages, Federal Institute of Industrial Property, Moscow, Russia.

The State Intellectual Property Office of China, First Office Action issued in Chinese application No. 201280015993.9, issue date Sep. 6, 2015, 24 pages translation included, The State Intellectual Property Office of China.

Translation of RU 54136U1 generated from Lexis Nexis Total Patents, 3 pages.

Translation of CN 201615398 generated from Lexis Nexis Total Patents, 3 pages.

Translation of CN 101761801 generated from Lexis Nexis Total Patents, 3 pages.

Translation of CN 200965196 generated from Lexis Nexis Total Patents, 2 pages.

Translation of CN 2906328 generated from Lexis Nexis Total Patents, 3 pages.

* cited by examiner

ASSEMBLY SYSTEMS FOR MODULAR LIGHT FIXTURES

CROSS-REFERENCE TO RELATED APPLICATIONS

The present application is related to U.S. patent application Ser. No. 14/152,598 titled "Floodlights With Multi-Path Cooling," which is being filed concurrently with the U.S. Patent and Trademark Office, and is hereby incorporated by reference in its entirety.

The present application is also related to U.S. patent application Ser. No. 13/436,172 titled "Light-Emitting Diode (LED) Floodlight", which itself claims priority from U.S. Provisional Patent Application No. 61/470,554, titled "Light-Emitting Diode (LED) Floodlight". The entire contents of both are hereby incorporated herein by reference.

TECHNICAL FIELD

The present disclosure relates generally to creating a light fixture from individual light modules and more particularly to systems, methods, and devices for creating a floodlight fixture from individual floodlight modules.

BACKGROUND

Floodlights are used in many different applications. Such floodlights may be used, for example, in commercial applications and residential applications. Floodlights may also be used in industrial applications and other harsh environments, including but not limited to military applications, onboard ships, assembly plants, power plants, oil refineries, and petrochemical plants. When a floodlight is used in such harsh environments, the floodlight must comply with one or more standards and/or regulations to ensure safe and reliable operation. With the development of lighting technologies (e.g., light emitting diode (LED)) that offer alternatives to incandescent lamps, floodlights using such lighting technologies are becoming more common.

SUMMARY

In general, in one aspect, the disclosure relates to a light fixture having a first light module, a second light module, and at least one first bracket. The first light module can include at least one first coupling feature, a first power source, and at least one first electrical receiver providing access to the first power source. The second light module can include at least one second coupling feature, a second power source, and at least one second electrical receiver providing access to the second power source. The at least one first bracket of the light fixture can include a first portion and a second portion, where the first portion mechanically couples to the at least one first coupling feature of the first light module, and where the second portion mechanically couples to the at least one second coupling feature of the second light module.

In another aspect, the disclosure can generally relate to an assembly system for a light fixture. The assembly system can include at least one first bracket having a first portion and a second portion, where the first portion is configured to mechanically couple to at least one first coupling feature of a first light module, and where the second portion is configured to mechanically couple to at least one second coupling feature of a second light module. The first light module can include a first power source, and the second light module can include a second power source.

These and other aspects, objects, features, and embodiments will be apparent from the following description and the appended claims.

BRIEF DESCRIPTION OF THE DRAWINGS

The drawings illustrate only exemplary embodiments and are therefore not to be considered limiting of its scope, as the exemplary embodiments may admit to other equally effective embodiments. The elements and features shown in the drawings are not necessarily to scale, emphasis instead being placed upon clearly illustrating the principles of the exemplary embodiments. Additionally, certain dimensions or positionings may be exaggerated to help visually convey such principles. In the drawings, reference numerals designate like or corresponding, but not necessarily identical, elements.

DETAILED DESCRIPTION

Figure 1A:
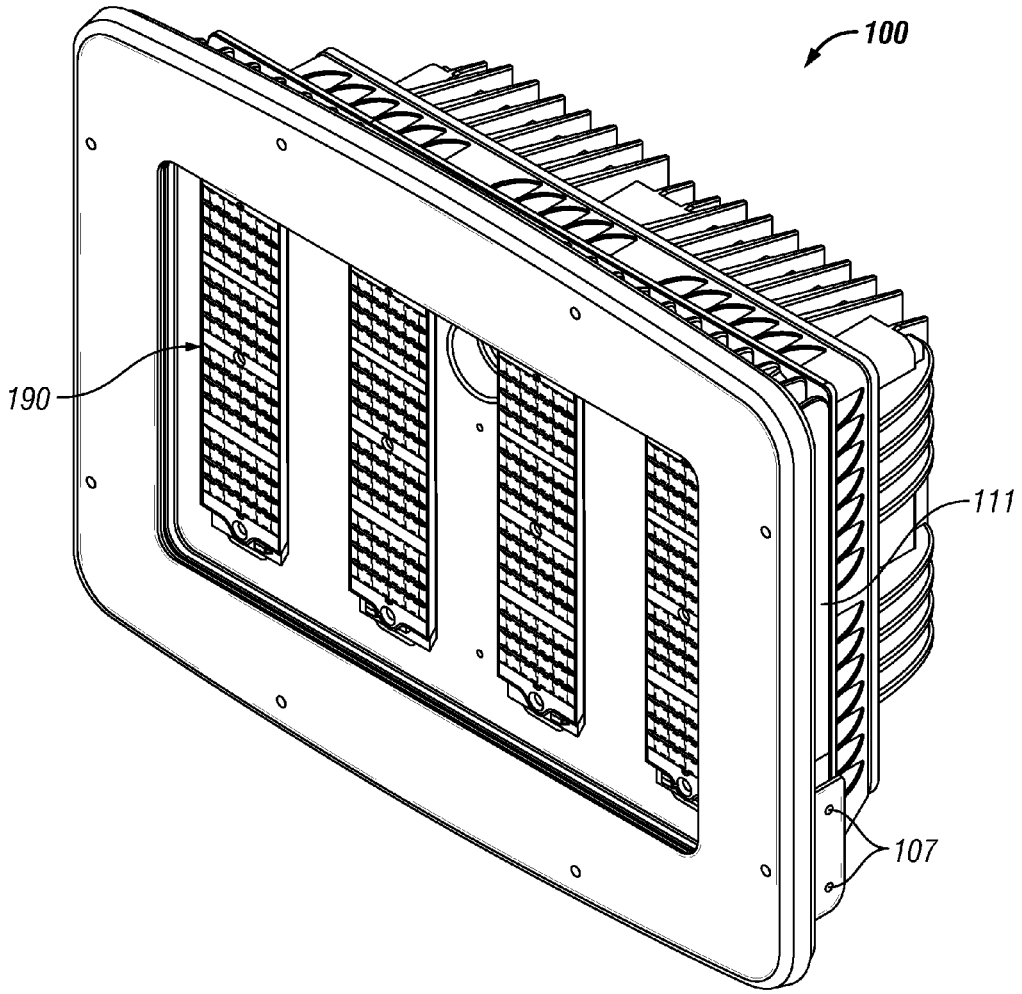
FIGS. 1A-1C show various views of a light module in accordance with certain example embodiments.

The example embodiments discussed herein are directed to systems, apparatuses, and methods associated with assembly systems for modular light fixtures. While the Figures shown and described herein are directed to floodlights, the disclosed embodiments are also applicable to one or more other types of light fixtures (e.g., spotlights, nightlights, emergency egress lights, high-bay light fixtures). Generally, the floodlight, which is used with example assembly systems, can be called a light fixture herein, where the light fixture includes at least two light modules. Example embodiments can be used in one or more of a variety of environments, indoors or outdoors, where the light fixture can be mounted and exposed. Example environments can include, but are not limited to, conditions with moisture, humidity, dirt, exhaust fumes, vibrations, potential explosions, and noise.

Example light fixtures can use LED technology. The LED can be one or more of a number of types of LED technology, including but not limited to discrete LEDs, LED arrays, chip-on-board LEDs, edge lit LED panels, and surface mounted LEDs. One or more LEDs can be mounted on a light board, and one or more light modules of a LED light fixture can include one or more light boards. Example light fixtures can also be used with different types of light sources using one or more of a number of types of sockets into which the light sources are electrically and mechanically coupled. Examples of a socket can include, but are not limited to, an Edison screw base of any diameter (e.g., E26, E12, E 14, E39), a bayonet style base, a bi-post base, a bi-pin connector base, a wedge base, and a fluorescent tube base. A light source can electrically and mechanically couple to the socket and can be of a light source type that corresponds to the socket. Examples of light source types can include, but are not limited to, incandescent lamps, LEDs, halogen lamps, G10/GU10, G9/GU9, AR111/PAR36, T3, MR-11, and MR-16.

Example light fixtures can be of any size and/or shape. A light fixture can be mounted to a surface (e.g., wall, ceiling, pillar), can be a light module in a light fixture, and/or can be used with any other suitable mounting instrument. Such light fixtures can be used in residential, commercial, and/or industrial applications. Such light fixtures can operate from a manual device (e.g., on/off switch, dimming switch, pull chain), a photocell, a timer, and/or any other suitable mechanism.

The assembly system and associated light fixture (or components thereof, such as individual light modules) described herein can be made of one or more of a number of suitable materials to allow the light fixture, when used with example assembly systems, to meet certain standards and/or regulations while also maintaining durability in light of the one or more conditions under which the example light fixture can be exposed. Examples of such materials can include, but are not limited to, aluminum, stainless steel, fiberglass, glass, plastic, and rubber. Light fixtures described herein, when used with example assembly systems, can be rated for one or more of a number (or range) of light color (CCT), light accuracy (CRI), voltages, and/or amperes. Example light fixtures described herein should not be considered limited to a particular CCT, CRI, voltage, and/or amperage rating.

In one or more example embodiments, a light fixture, when used with example assembly systems, is subject to meeting certain standards and/or requirements. For example, the International Electrotechnical Commission (IEC) publishes ratings and requirements for LED floodlights. Specifically, the IEC publishes IP (which stands for Ingress Protection or, alternatively, International Protection) Codes that classify and rate the degree of protection provided against intrusion of solid objects, dust, and water in mechanical casings and electrical enclosures. One such IP Code is IP66, which means that a LED floodlight having such a rating is dust tight and protects against powerful water jets (in this case, 100 liters of water per minute under a pressure of 100 $kN/m^2$ at a distance of 3 meters) for a duration of at least 3 minutes.

The IEC also publishes temperature ratings for electrical equipment. For example, if a device is classified as having a T4 temperature rating, then the surface temperature of the device will not exceed 135° C. Other entities (e.g., the National Electrical Manufacturers Association (NEMA), the National Electric Code (NEC), Underwriters' Laboratories, Inc. (UL)) may also publish standards and/or requirements for LED floodlights.

Example embodiments of light fixtures may meet one or more of a number of standards set by one or more of a number of authorities. Examples of such authohrities include, but are not limited to, the National Electric Code (NEC), the Canadian Electric Code (CEC), the IEC, the NEMA, Underwriter's Laboratories (UL), the Standards Council of Canada, Conformité Européenne (CE), and the Appareils destinés à être utilisés en Atmosphères Explosives (ATEX). Examples of such standards include, but are not limited to, Class I, division 2, groups A, B, C, and/or D; Class I, Zone 2; Class II, groups E, F, and/or G; Class III simultaneous presence; Marine and/or Wet locations; Type 4X; IP66; and Ex nA Zone 2.

In addition, the light modules of the light fixtures described herein are rectangular in shape. In other words, each assembly and/or member of the example light modules of the light fixtures shown and described herein are substantially rectangular. One or more assemblies and/or members of an example light modules of a light fixture can have any of a number of other shapes, including but not limited to circular, oval, hexagonal, square, and triangular.

A user as described herein may be any person that interacts, directly or remotely, with light fixtures using example assembly systems. Specifically, a user may install, maintain, operate, and/or interface with a light fixture. Examples of a user may include, but are not limited to, an engineer, an electrician, an instrumentation and controls technician, a mechanic, an operator, a consultant, a contractor, and a manufacturer's representative.

Example embodiments will now be described in detail with reference to the accompanying figures, in which example embodiments of light fixtures using assembly systems are shown. Light fixtures using assembly systems may, however, be embodied in many different forms and should not be construed as limited to the example embodiments set forth herein. Rather, these example embodiments are provided so that this disclosure will be thorough and complete, and will fully convey the scope of light fixtures using assembly systems to those of ordinary skill in the art. Like, but not necessarily identical, elements (also sometimes called assemblies, members, or components) in the various figures are denoted by like reference numerals for consistency.

Terms such as "first," "second," "top," "center," "width," "height," "bottom," "back," "front," and "side" are used merely to distinguish one component (or part of a component or state of a component) from another. Such terms are not meant to denote a preference or a particular orientation, and are not meant to limit embodiments of light fixtures using assembly systems. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 1B:
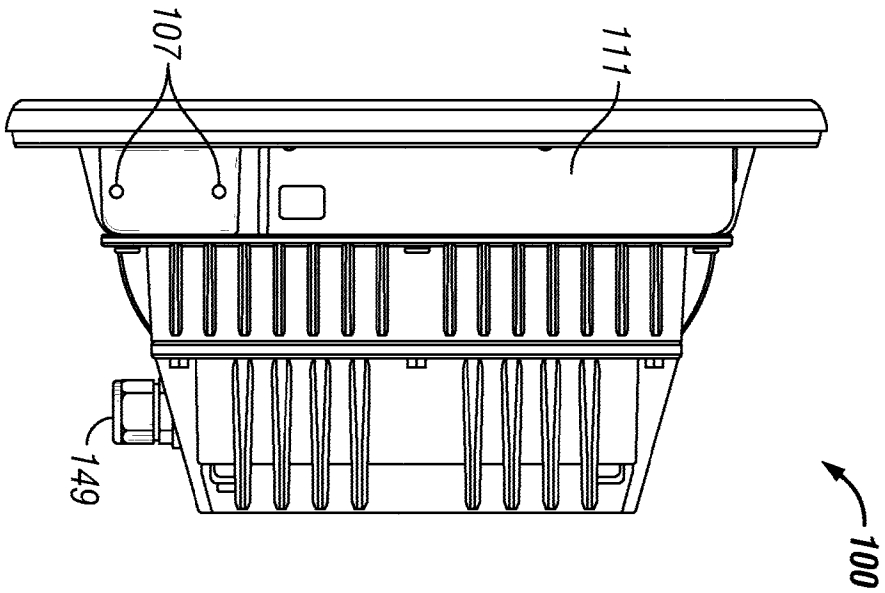
Figure 1C:
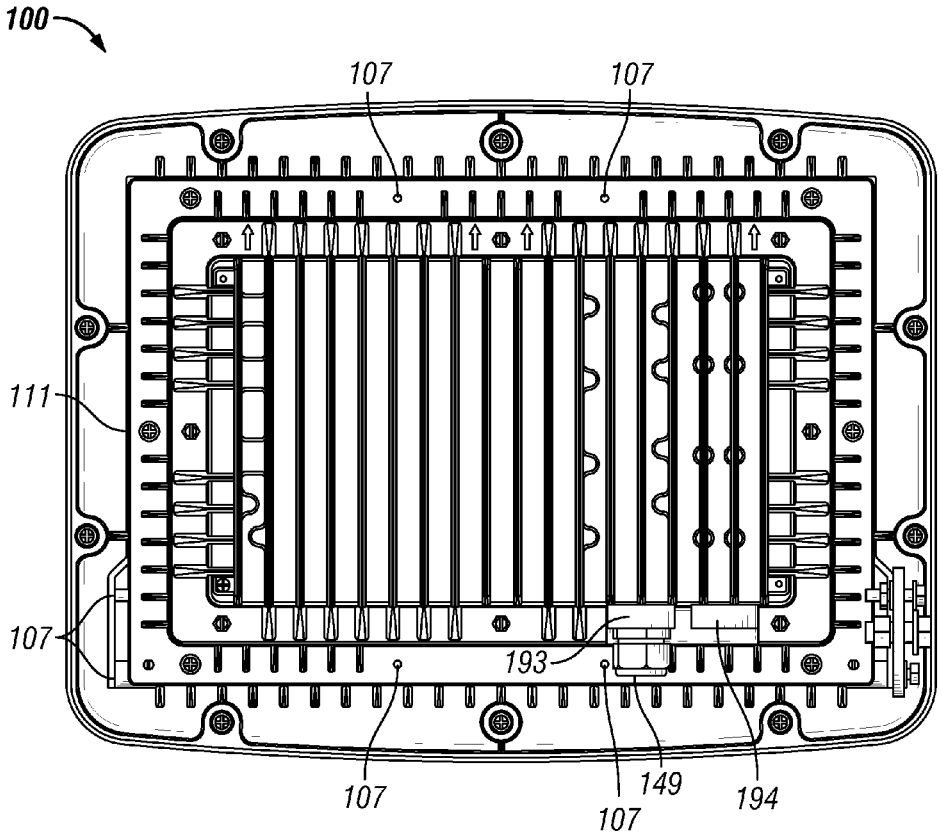
Figure 2:
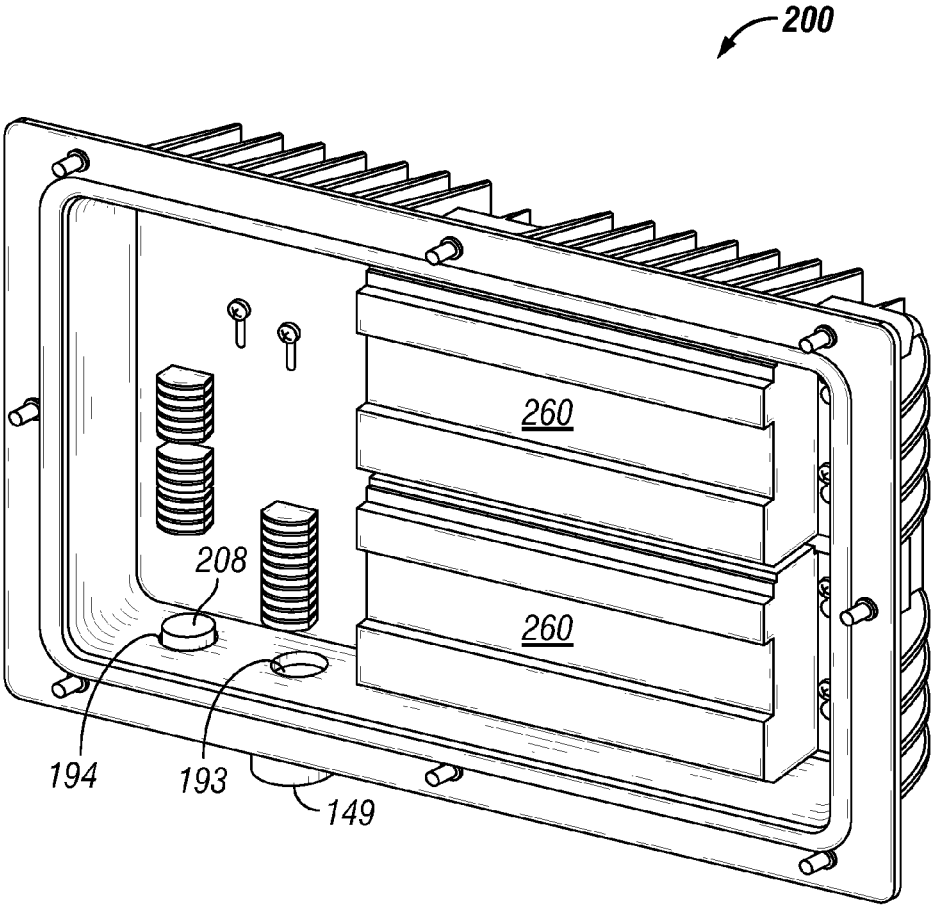
FIG. 2 shows a perspective view of a power supply of a light module in accordance with certain example embodiments.

FIGS. 1A-1C show various views of a light module in accordance with certain example embodiments. FIG. 1A shows a front perspective view of the light module 100. FIG. 1B shows a side view of the light module 100. FIG. 1C shows a rear view of the light module 100. Further, FIG. 2 shows a portion 200 of the light module 100 of FIGS. 1A-1C, where the portion 200 includes the power source 260. In one or more embodiments, one or more of the components shown in FIGS. 1A-2 may be omitted, repeated, and/or substituted. Accordingly, embodiments of a light module should not be considered limited to the specific arrangements of components shown in FIGS. 1A-2.

Referring to FIGS. 1A-2, the light module 100 is an example of a light module that can be used in a light fixture using example embodiments. The light module 100 can include its own power source 260 (as shown, for example, in FIG. 2), at least one coupling feature 107, at least one light source 190, and at least one electrical receiver (e.g., electrical receiver 193, electrical receiver 194). The power source 260 can be a driver assembly (as when the light source 190 uses LED technology), a ballast, and/or some other source that provides power to the light source 190 of the light module 100. The power source 260 can include one or more of a number of components used to create power and control for the light module 100. Such components of the power source 260 can include, but are not limited to, a transformer, a resistor, a diode, and integrated circuit, and an inductor. More details of the example light module 100 shown in FIGS. 1A-1C are described in the patent application titled "Light-Emitting Diode (LED) Floodlights," having Ser. No. 14/152, 598, and hereby incorporated by reference in its entirety. With respect to example assembly systems, two or more of any light module of any configuration can be used.

In certain example embodiments, each light module 100 has multiple electrical receivers (e.g., electrical receiver 193, electrical receiver 194). An electrical receiver can be an aperture in the housing of the light module 100. In addition, or in the alternative, an electrical receiver can include part (e.g., male, female) of a connector plug. In any case, at least one of the electrical receivers of a light module 100 can receive a cable (a bridge cable, a power cable) to allow the cable to be mechanically (and, in some cases, electrically) coupled to the power source 260 of the light module 100. When there are multiple electrical receivers for a light module 100, one electrical receiver (e.g., electrical receiver 193) can be called a first electrical receiver 193, and another electrical receiver (e.g., electrical receiver 194) can be called a second electrical receiver 194. The first electrical receiver 193 can receive a cable (allow a cable to be disposed therein) so that the cable can be mechanically and, in some cases, electrically, coupled to the power source 260. In such a case, the other end of the cable can be mechanically and, in some cases, electrically, coupled to an external power source.

If the external power source is received from another light module 100, the cable can be called a bridge cable. Such a configuration allows for the daisy-chaining (in series and/or in parallel) of power among light modules 100 in a light fixture. Specifically, one end of the bridge cable can be disposed in the second electrical receiver 193 so that the cable can be mechanically and, in some cases, electrically, coupled to the power source 260 of one light module 100 in a light fixture, and the other end of the bridge cable (such as, for example, bridge cable 690 shown in FIGS. 6A-6E below) can be disposed in the first electrical receiver 194 so that the cable can be mechanically and, in some cases, electrically, coupled to the power source 260 of another light module 100 in the light fixture. Alternatively, if the external power source is a device external to the light fixture (e.g., a switch, a motor control center), the cable can be called a power cable.

In certain example embodiments, a cable gland 149 is disposed within an electrical receiver of a light module 100. For example, as shown in FIGS. 1C and 2, a cable gland 149 is disposed in the electrical receiver 193. The cable gland 149 can have one or more coupling features (e.g., mating threads) that allow the cable gland 149 to mechanically couple to the electrical receiver 193. The cable gland 149 can (either by itself or in conjunction with another device, including but not limited to a sealing device and silicone caulk) be used to provide a seal between the cable gland 149 and the electrical receiver 193. The cable gland 149 can also provide a seal between the cable gland 149 and one or more cables that are disposed within the cable gland 149. In any case, such a seal can prevent water, dust, and other contaminants from outside the housing of the light module 100 from entering the light module 100.

Alternatively, a plug 208 can be inserted into an electrical receiver if the electrical receiver is not used. For example, as shown in FIG. 2, a plug 208 is inserted into the electrical receiver 194. The plug 208 can have one or more coupling features (e.g., mating threads) that allow the plug 208 to mechanically couple to the electrical receiver 194. The plug 208 can be a solid piece and can (either by itself or in conjunction with another device, including but not limited to a sealing device and silicone caulk) be used to provide a seal between the plug 208 and the electrical receiver 194. The plug 208 can also provide a seal between the plug 208 and one or more cables that are disposed within the plug 208. In any case, such a seal can prevent water, dust, and other contaminants from outside the housing of the light module 100 from entering the light module 100.

The one or more coupling features 107 can be disposed at one or more locations on a light module 100. For example, as shown in FIGS. 1A-1C, a light module 100 can have coupling features on either or both sides 111 and/or on the back (also called the rear) of the light module 100. A coupling feature 107 can allow one or more components (e.g., side bracket 300, rear bracket 400) of the assembly system to become mechanically coupled, directly or indirectly, to the light module 100. For example, one or more coupling features 107 disposed on a side 111 of a light module 100 can be used to mechanically couple the side bracket 300 of the assembly system to the light module 100. As another example, one or more coupling features 107 disposed on the rear of a light module 100 can be used to mechanically couple the rear bracket 400 of the assembly system to the light module 100. As yet another example, one or more coupling features 107 disposed on the rear of a light module 100 can be used to mechanically couple the center interface 500 of the assembly system to the light module 100.

The coupling features 107 can include, but are not limited to, a portion of a hinge, an aperture (as shown), a slot, a tab, a detent, and a mating thread. A side bracket 300, a rear bracket 400, a center interface 500, and/or another component of the example assembly system can be coupled to the light module 100 by the direct use of the coupling features 107. In addition, or in the alternative, side bracket 300, the rear bracket 400, the center interface 500, and/or another component of the example assembly system can be coupled to the light module 100 using one or more independent devices that interact with the coupling features 107 disposed on the light module 100. Examples of such devices can include, but are not limited to, a pin, a hinge, a fastening device (e.g., fastening device 629 described below with respect to FIGS. 6A-6E), and a spring. One coupling feature 107 of a light module 100 can be the same as, or different than, one or more other coupling features 107 of the light module 100.

The various features (e.g., size, shape, type of light source, color) of the light module 100 can vary. Since a light fixture using example assembly systems includes two or more light modules 100, the features of one light module 100 in a light fixture can be substantially the same as, or different than, the corresponding features of the one or more other light modules 100 in the light fixture.

Figure 4:
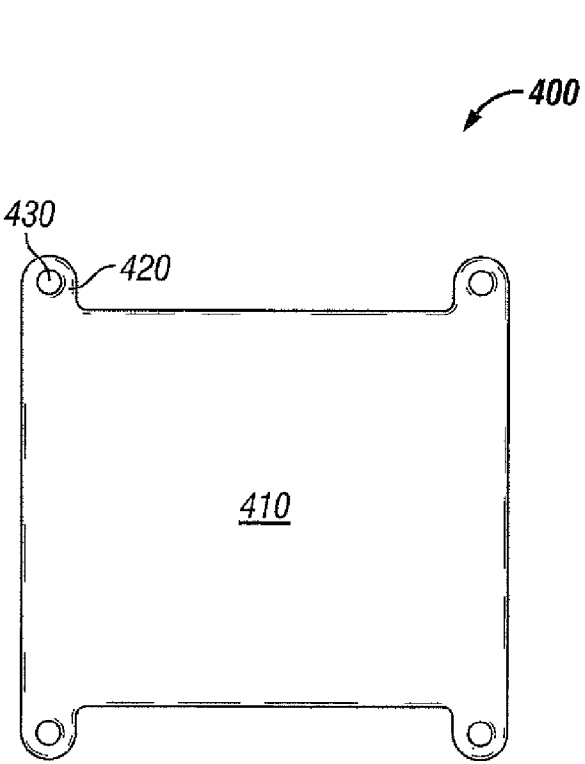
FIG. 4 shows a front view of a rear bracket of an assembly system in accordance with certain example embodiments.
Figure 3B:
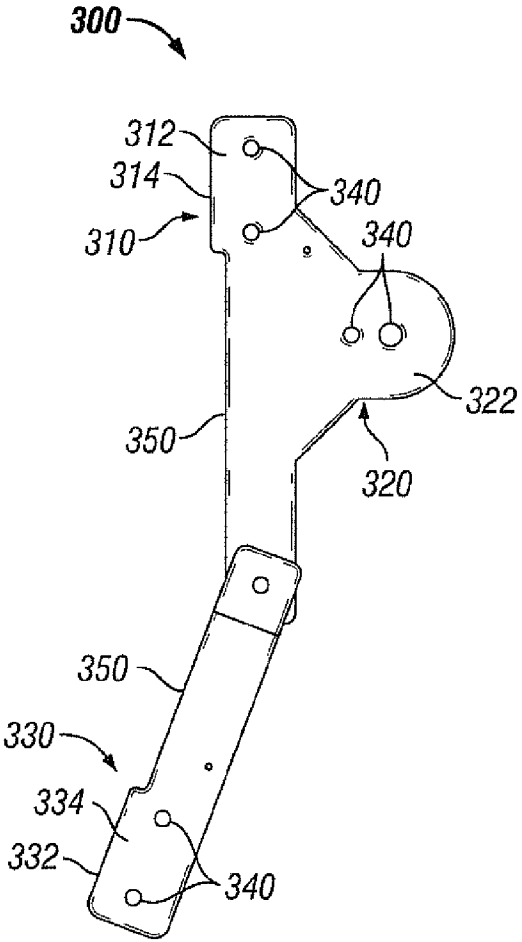
FIGS. 3A and 3B show a front view of side brackets of an assembly system in accordance with certain example embodiments.
Figure 3A:
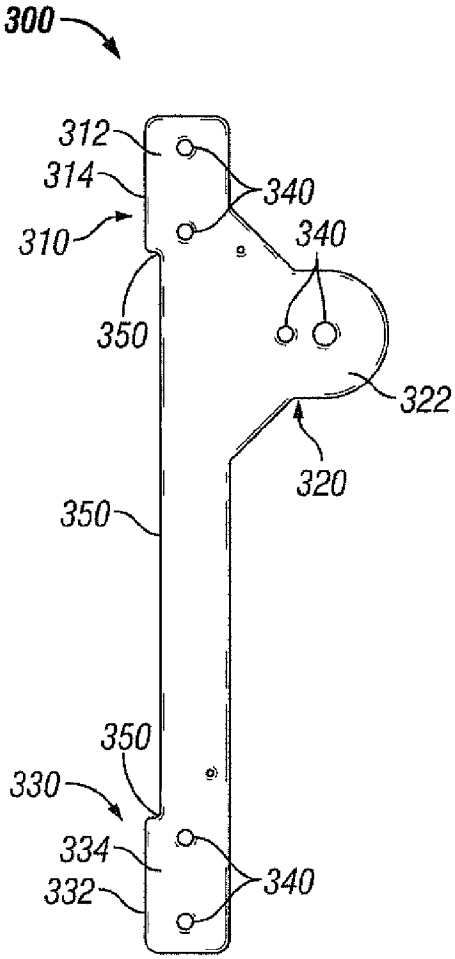
Figure 5A:
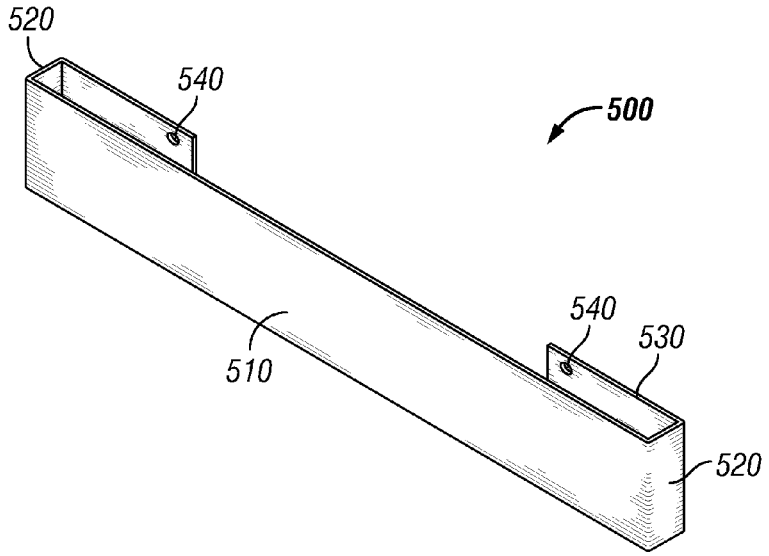
FIGS. 5A-5C shows various views of a center interface of an assembly system in accordance with certain example embodiments.
Figure 5B:
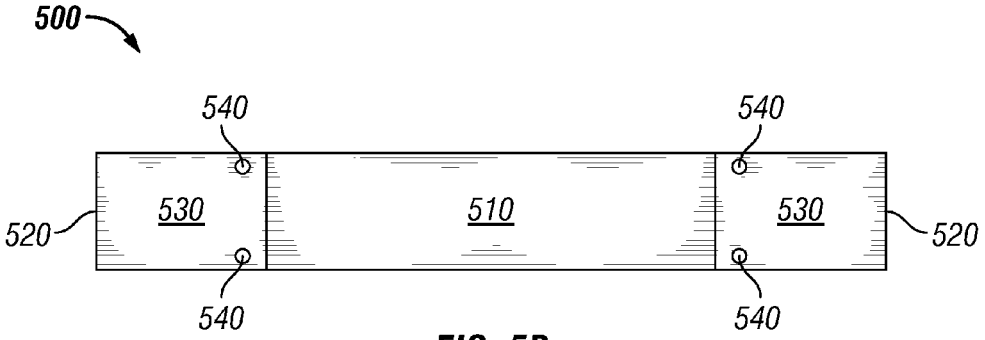
Figure 5C:
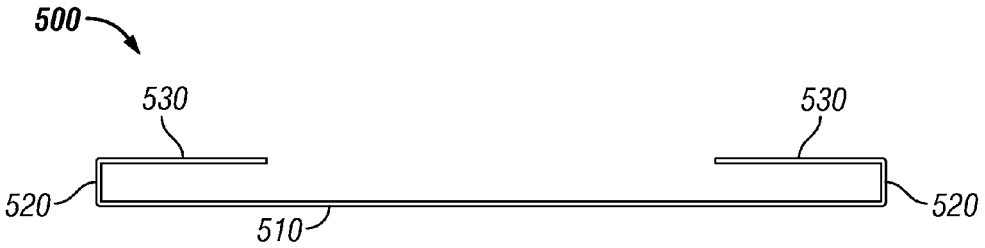

Example assembly systems described herein include one or more of a number of components. Examples of such components are a side bracket 300, a rear bracket 400, and a center interface 500. FIG. 3A shows a front view of a side bracket 300 of an assembly system in accordance with certain example embodiments. FIG. 3B shows a front view of an adjustable side bracket 300 of an assembly system in accordance with certain example embodiments. FIG. 4 shows a front view of a rear bracket 400 of an assembly system in accordance with certain example embodiments. FIGS. 5A-5C show various views of a center interface 500 of an assembly system in accordance with certain example embodiments. In one or more embodiments, one or more of the components shown in FIGS. 3A-5C may be omitted, repeated, and/or substituted. Accordingly, embodiments of components of an assembly system should not be considered limited to the specific components and/or arrangements of components shown in FIGS. 3A-5C.

Referring to FIGS. 1A-5C, the side bracket 300 of FIGS. 3A and 3B can include one or more portions. For example, as shown in FIGS. 3A and 3B, the side bracket 300 can include a top portion 310, a middle portion 320, and a bottom portion 330. In such a case, the top portion 310 can include at least one coupling feature 340 that mechanically couples the top portion 310 of the side bracket 300 to a portion of a light module 100. The one or more coupling features 340 can include, but are not limited to, a portion of a hinge, an aperture (as shown), a slot, a tab, a detent, and a mating thread. The side bracket 300 can be coupled to a portion (e.g., one or more coupling features 107 disposed on a side 111) of a light module 100 by the direct use of the coupling features 340. In addition, or in the alternative, the side bracket 300 can be coupled to the light module 100 using one or more independent devices that interact with the coupling features 340 disposed on the top portion 310 of the side bracket 300. Examples of such devices can include, but are not limited to, a pin, a hinge, a fastening device (e.g., fastening device 629 described below with respect to FIGS. 6A-6E), and a spring. One coupling feature 340 of the top portion 310 of a side bracket 300 can be the same as, or different than, one or more other coupling features 340 of the side bracket 300.

Similar to the top portion 310, the bottom portion 330 of the side bracket 300 can include at least one coupling feature 340 that mechanically couples the top portion 310 of the side bracket 300 to a portion of a light module 100. The one or more coupling features 340 of the bottom portion 330 can include, but are not limited to, a portion of a hinge, an aperture (as shown), a slot, a tab, a detent, and a mating thread. The side bracket 300 can be coupled to a portion (e.g., one or more coupling features 107 disposed on a side 111) of a light module 100 by the direct use of the coupling features 340. In addition, or in the alternative, side bracket 300 can be coupled to the light module 100 using one or more independent devices that interact with the coupling features 340 disposed on the bottom portion 330 of the side bracket 300. Examples of such devices can include, but are not limited to, a pin, a hinge, a fastening device, and a spring. One coupling feature 340 of the bottom portion 330 of a side bracket 300 can be the same as, or different than, one or more other coupling features 340 of the side bracket 300.

The middle portion 320 of the side bracket 300 can be disposed at any point along the side bracket 300 between the top portion 310 and the bottom portion 330. For example, as shown in FIGS. 3A and 3B, the middle portion 320 can be adjacent to the top portion 310. The middle portion 320 can extend from one side of the side bracket 300. The middle portion 320 of the side bracket 300 can include one or more coupling features 340. The one or more coupling features 340 of the middle portion 320 can include, but are not limited to, a portion of a hinge, an aperture (as shown), a slot, a tab, a detent, and a mating thread. The side bracket 300 can be coupled to a portion (e.g., the optional mounting assembly 680) of a light fixture by the direct use of the coupling features 340. In addition, or in the alternative, middle portion 320 can be coupled to a portion of the light fixture using one or more independent devices that interact with the coupling features 340 disposed on the middle portion 320 of the side bracket 300. Examples of such devices can include, but are not limited to, a pin, a hinge, a fastening device, and a spring. One coupling feature 340 of the middle portion 320 of a side bracket 300 can be the same as, or different than, one or more other coupling features 340 of the side bracket 300.

In certain example embodiments, the side bracket 300 can have one or more features that enhance the strength of the side bracket 300 in supporting one or more light modules 100, the optional mounting assembly 680, and/or one or more other components of the light fixture. For example, as shown in FIGS. 3A and 3B, the side bracket 300 can include a relief feature 350 that traverses at least a portion of the length of the side bracket 300. In addition to enhancing the strength of the side bracket 300, the relief feature 350 can allow another component of the assembly system to be disposed therein. For example, as described below, a portion of the center interface 500 can be disposed within the relief feature 350, allowing the center interface 500 to wrap around one or more light modules 100.

In certain example embodiments, the side bracket 300 can be made of one or more of a number of suitable materials, including but not limited to steel, titanium, and aluminum. Further, the side bracket 300 can have any suitable shape and/or size (e.g., height, width, thickness) to couple multiple light modules 100 to each other. If an assembly system includes multiple side brackets 300, the shape and/or size of one side bracket 300 can be substantially the same as, or different than, one or more of the other side brackets 300.

In certain example embodiments, the side bracket 300 is made of a single piece, as from a mold or a cast. In such a case, one or more portions (e.g., top portion 310, bottom portion 330) of a side bracket 300 can be linearly aligned (coplanar) with each other. For example, as shown in FIG. 3A, the top portion 310 and the bottom portion 330 of the side bracket 300 are at opposite ends of a linear section of the side bracket 300. In such a case, the light modules 100 mechanically coupled to the side bracket 300 can be directed in the same direction. Alternatively, one or more portions of the side bracket 300 can be aligned with each other at an angle relative to each other. For example, the top portion 310 and the bottom portion 330 of the side bracket 300 can be set at an angle (e.g., 135°) relative to each other. In such a case, the light modules 100 mechanically coupled to the side bracket 300 can be directed toward a point in front of the light modules 100.

Alternatively, as shown in FIG. 3B, one or more portions of the side bracket 300 is made of multiple pieces that are mechanically coupled to each other using one or more of a number of coupling methods, including but not limited to welding, fastening devices (e.g., clamps, brackets, bolts), and compression fittings. In certain example embodiments, the coupling methods used to mechanically couple two or more portions of the side bracket 300 to each other can be adjustable. For example, the adjustable coupling methods can allow the portions of the side bracket 300 to become decoupled from each other. As another example, the adjustable coupling methods can allow the distance between the portions of the side bracket 300 to be adjusted. As yet another example, as shown in FIG. 3B, the adjustable coupling methods can allow the angle formed between the top portion 310 and the bottom portion 330 of the side bracket 300 to be adjusted.

The rear bracket 400 of the assembly system, an example of which is shown in FIG. 4, can include one or more portions. For example, as shown in FIG. 4, the rear bracket 400 can include a main body 410 and one or more coupling extensions 420. In such a case, each coupling extension 420 can include at least one coupling feature 430 that mechanically couples the rear bracket 400 to a portion of one or more light modules 100. The one or more coupling features 430 can include, but are not limited to, a portion of a hinge, an aperture (as shown), a slot, a tab, a detent, and a mating thread. The rear bracket 400 can be coupled to a portion (e.g., one or more coupling features 107 disposed on a back side) of one or more light modules 100 by the direct use of the coupling features 430. In addition, or in the alternative, the rear bracket 400 can be coupled to the light module 100 using one or more independent devices that interact with the coupling features 430 disposed on the coupling extensions 420 of the rear bracket 400. Examples of such devices can include, but are not limited to, a pin, a hinge, a fastening device (e.g., fastening device 629 described below with respect to FIGS. 6A-6E), and a spring. One coupling feature 430 of a coupling extension 420 of a rear bracket 400 can be the same as, or different than, one or more other coupling features 430 of the rear bracket 400.

The coupling extensions 420 of the rear bracket 400 can be disposed at any point along the rear bracket 400. For example, as shown in FIG. 4, the main body 410 of the rear bracket 400 can be rectangular, and each coupling extension 420 can be disposed on each corner of the rear bracket 400, extending vertically away from the main body 410. The coupling extensions 420 can extend in any direction from a side of the main body 410 of the rear bracket 400. In addition, or in the alternative, a coupling extension 420 can be disposed within the main body 410 of the rear bracket 400. One coupling feature 430 of a rear bracket 400 can be the same as, or different than, one or more other coupling features 430 of the rear bracket 400.

In certain example embodiments, the rear bracket 400 can have one or more features that enhance the strength of the rear bracket 400 in supporting one or more light modules 100 and/or one or more other components of the light fixture. For example, main body 410 of the rear bracket 400 can include one or more stiffening features (e.g., ribs) disposed along some portion of the main body 410. The shape and size of the main body 410, as well as the shape, size, and position of the coupling extensions 420, can allow the rear bracket 400 to be positioned in a specific location relative to, and to be coupled to, one or more components of a light fixture. An example of this is shown below with respect to FIGS. 6A-6E.

The various portions of the rear bracket 400 can be planar (two dimensional) with respect to each other. Alternatively, the rear bracket 400 can be three dimensional. In other words, the main body 410 and/or one or more coupling extensions 420 can be set at an angle relative to itself and/or each other. For example, an apex can run along the width of the main body 410 to create an angle between one portion of the main body 410 and the other portion of the main body 410. The various components of the rear bracket 400 can be made from a single piece (as from a cast) or multiple pieces. When the rear bracket 400 is made of multiple pieces, the pieces can be mechanically coupled to each other using one or more of a number of coupling methods, including but not limited to welding, epoxy, fastening devices (e.g., bolts, brackets), and compressions fittings. One or more of the coupling methods can allow one or more components of the rear bracket 400 to be adjustable, either relative to itself or to another component of the rear bracket 400. For example, a hinge with detents can be disposed along the width of a bottom half and a top half of the main body 410. In such a case, the halves of the main body 410 can be set at various angles relative to each other.

In certain example embodiments, the rear bracket 400 can be made of one or more of a number of suitable materials, including but not limited to steel, titanium, and aluminum. Further, the rear bracket 400 can have any suitable shape and/or size (e.g., height, width, thickness) to couple multiple light modules 100 to each other. If an assembly system includes multiple rear brackets 400, the shape and/or size of one rear bracket 400 can be substantially the same as, or different than, one or more of the other rear bracket 400.

In certain example embodiments, the center interface 500 is optional and is used for aesthetic purposes. Alternatively, the center interface 500 can be a required component of the example assembly system. The center interface 500 of the example assembly system, an example of which is shown in FIGS. 5A-5C, can include one or more portions. For example, the center interface 500 can have a front portion 510, at least one side portion 520, and at least one rear portion 530.

The front portion 510 can have a height sufficient to cover a gap that exists between two or more adjacent light modules 100 when those light modules 100 are mechanically coupled to each other by one or more components (e.g., two side brackets 300) of the assembly system. The front portion 510 of the center interface 500, when mechanically coupled to one or more light modules 110, can be disposed over the front surface of at least part of a component (e.g., the bezel) of the same and/or a different light module 110. In addition, or in the alternative, the front portion 510 can have a width that is at least slightly greater than the width of one or more light modules 100. The width and/or the height of the center portion 510 of the center interface 500 can be substantially uniform or variable throughout.

The one or more side portions 520 of the center interface 500, when mechanically coupled to one or more light modules 110, can be disposed over a side surface of at least part of a component (e.g., the bezel, a flange of a housing assembly) of the same and/or a different light module 110. In addition, or in the alternative, a side portion 520 can have a width that is at least slightly greater than the width of at least a portion one or more light modules 100. The width and/or the height of the side portion 520 of the center interface 500 can be substantially uniform or variable throughout. If there are multiple side portions 520, the shape and/or size of one side portion 520 can be substantially the same as or different than the other side portions 520.

The one or more rear portions 530 of the center interface 500, when mechanically coupled to one or more light modules 110, can be disposed over a back surface of at least part of a component (e.g., the bezel, a flange of a housing assembly) of the same and/or a different light module 110. The width and/or the height of a rear portion 530 of the center interface 500 can be substantially uniform or variable throughout. If there are multiple rear portions 530, the shape and/or size of one rear portion 530 can be substantially the same as or different than the other rear portions 530.

The center interface 500 can include one or more of a number of coupling features 540 that mechanically couples the center interface 500 to a portion of one or more light modules 100. The one or more coupling features 540 can include, but are not limited to, a portion of a hinge, an aperture (as shown), a slot, a tab, a detent, and a mating thread. The center interface 500 can be coupled to a portion (e.g., one or more coupling features 107 disposed on the rear) of a light module 100 by the direct use of the coupling features 540. In addition, or in the alternative, the center interface 500 can be coupled to the light module 100 using one or more independent devices that interact with the coupling features 540 disposed on a portion (e.g., one or more rear portions 530, as shown in FIGS. 5A-5C) of the center interface 500. Examples of such devices can include, but are not limited to, a pin, a hinge, a fastening device, and a spring. One coupling feature 540 of the center interface 500 can be the same as, or different than, one or more other coupling features 540 of the center interface 500.

The front portion 510, the one or more side portions 520, and the one or more rear portions 530 can be formed from a single piece (e.g., folded, taken from a cast or mold) or can be formed from multiple pieces that are mechanically coupled to each other using one or more of a number of coupling methods, including but not limited to welding, epoxy, fastening devices (e.g., bolts, brackets), and compressions fittings. When the center interface 500 is made of multiple pieces, the multiple pieces can be adjusted relative to itself and/or to each other. For example, the front portion 510 can be made of two pieces that are slidably coupled to each other, allowing the width of the front portion 510 (and, thus, the spacing between the rear portions 530) can be adjusted by a user.

Figure 6A:
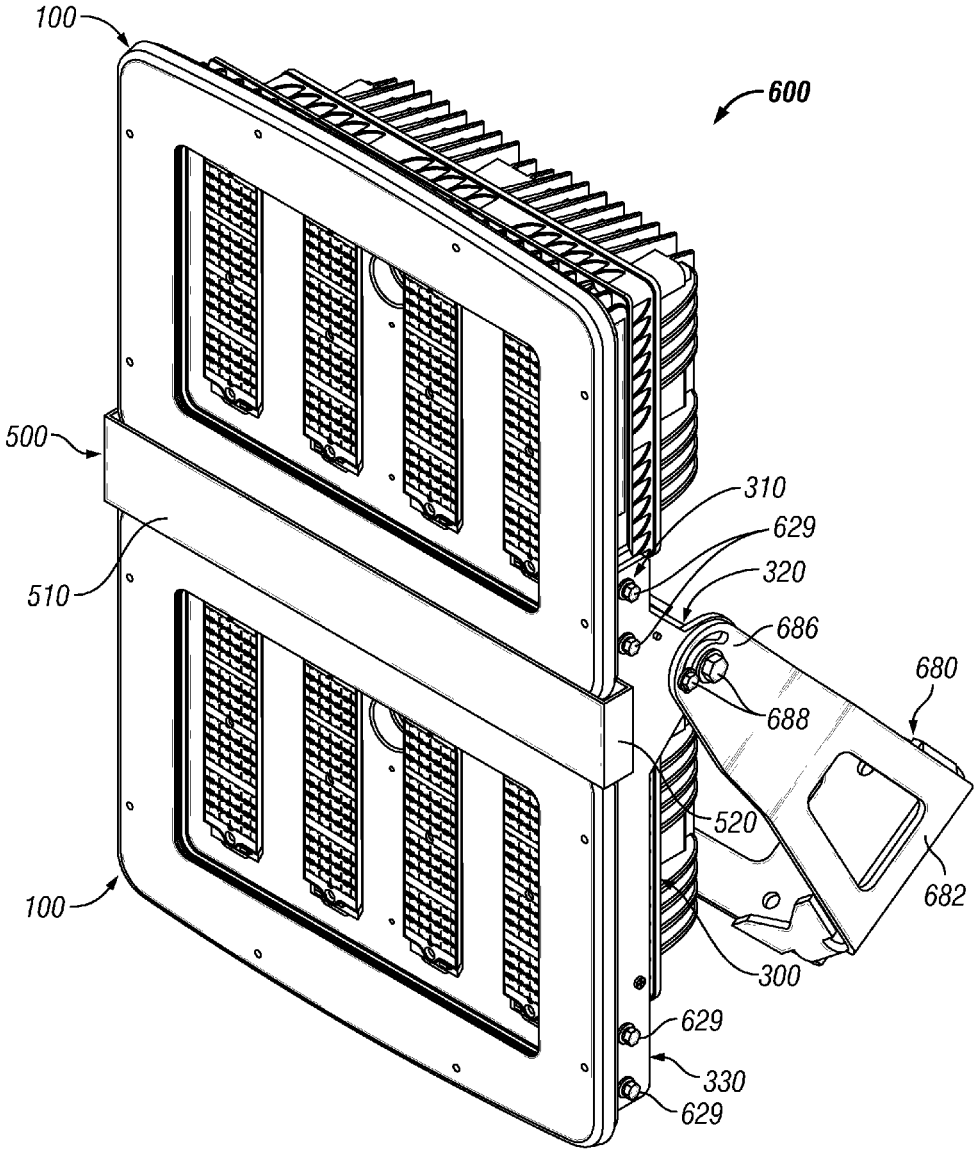
FIGS. 6A-6E show various views of a light fixture in accordance with certain example embodiments.
Figure 6B:
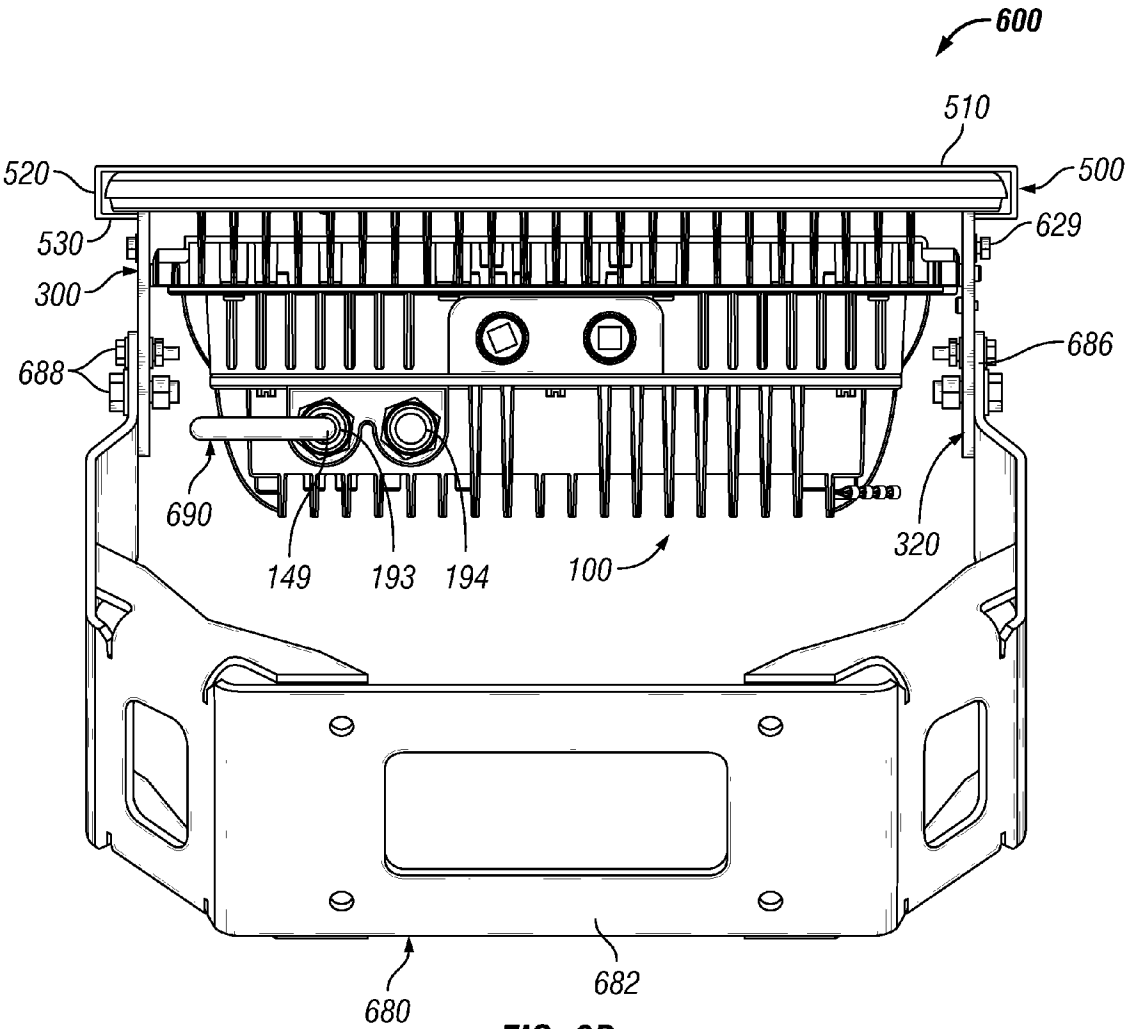
Figure 6C:
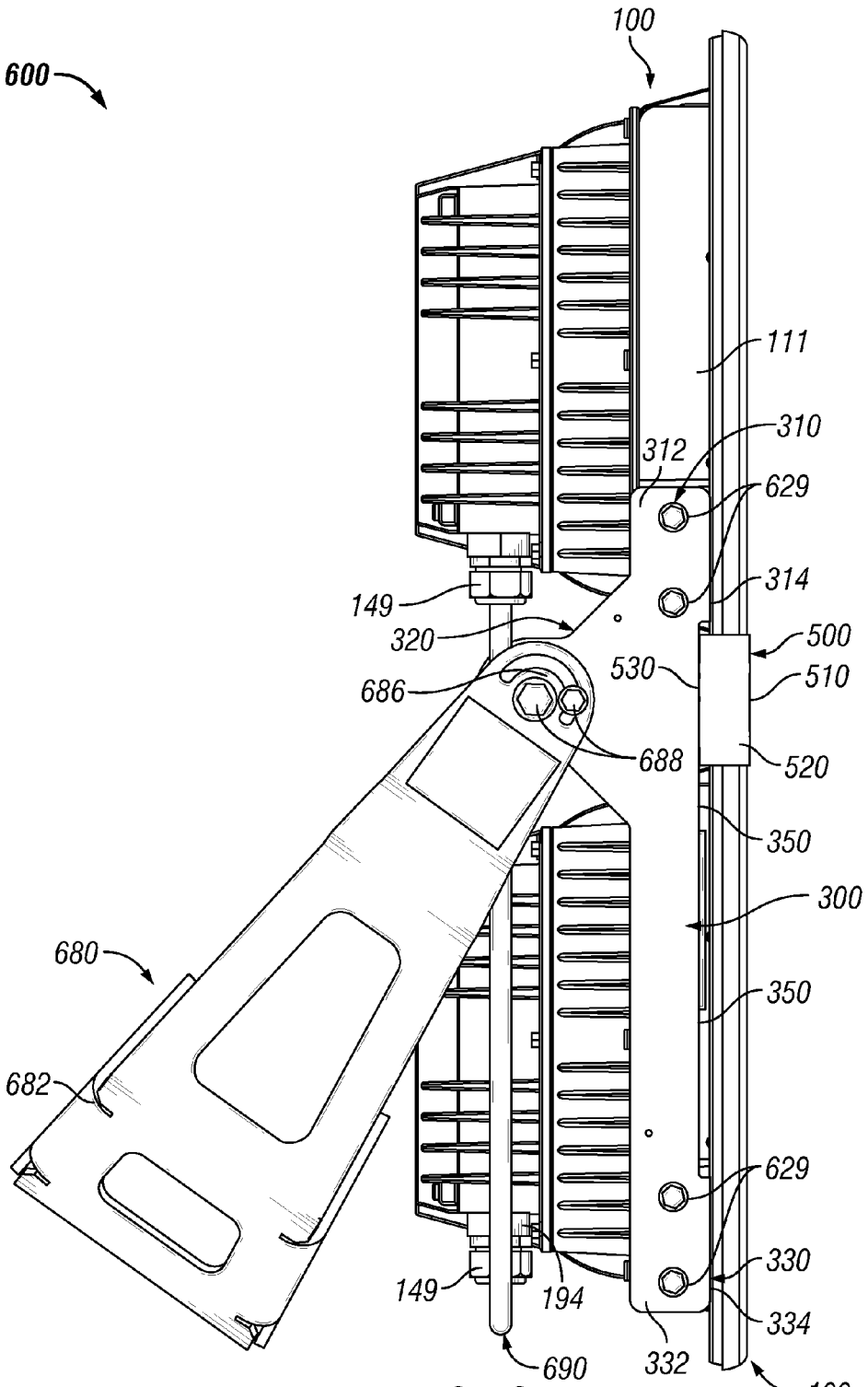
Figure 6D:
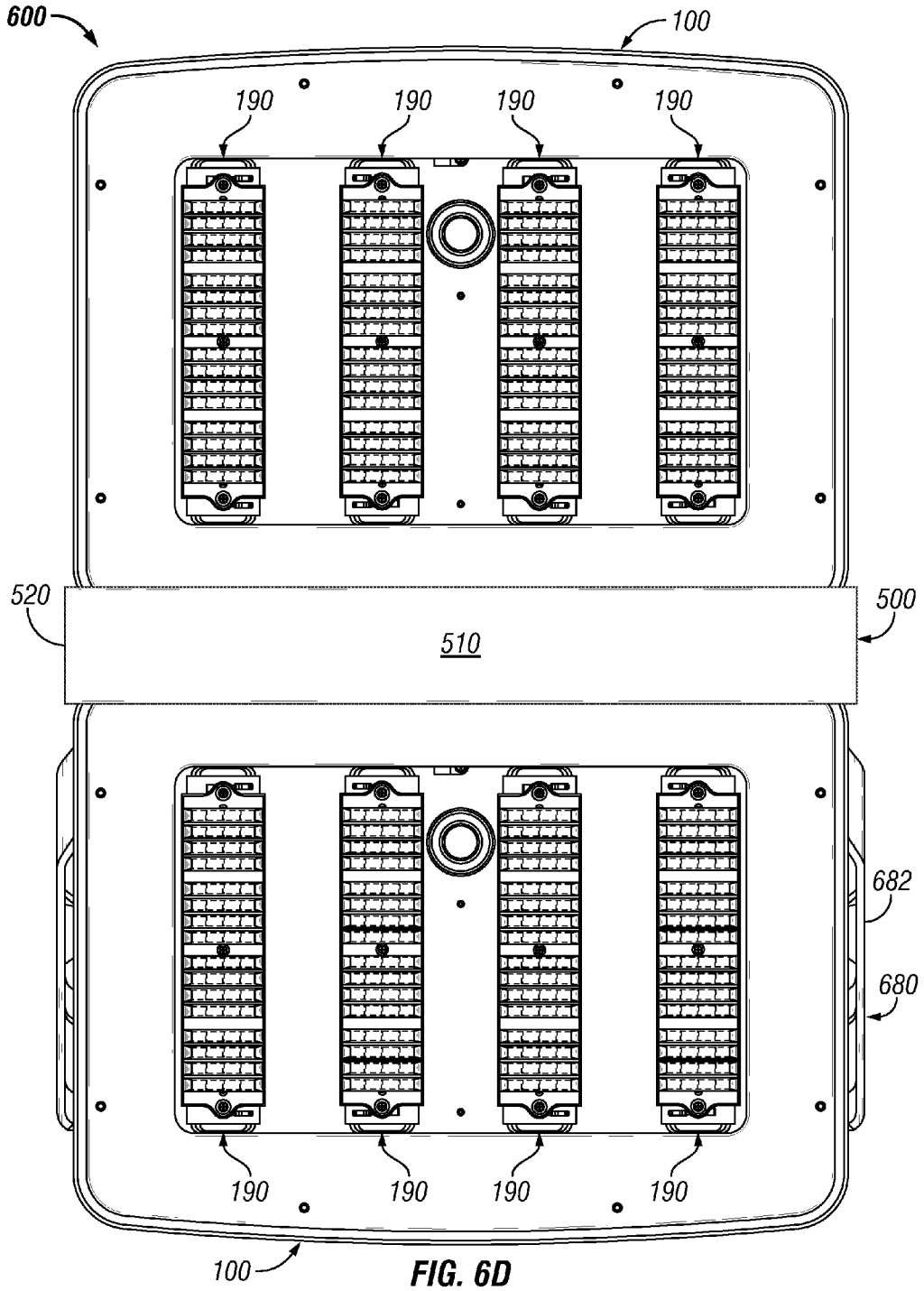
Figure 6E:
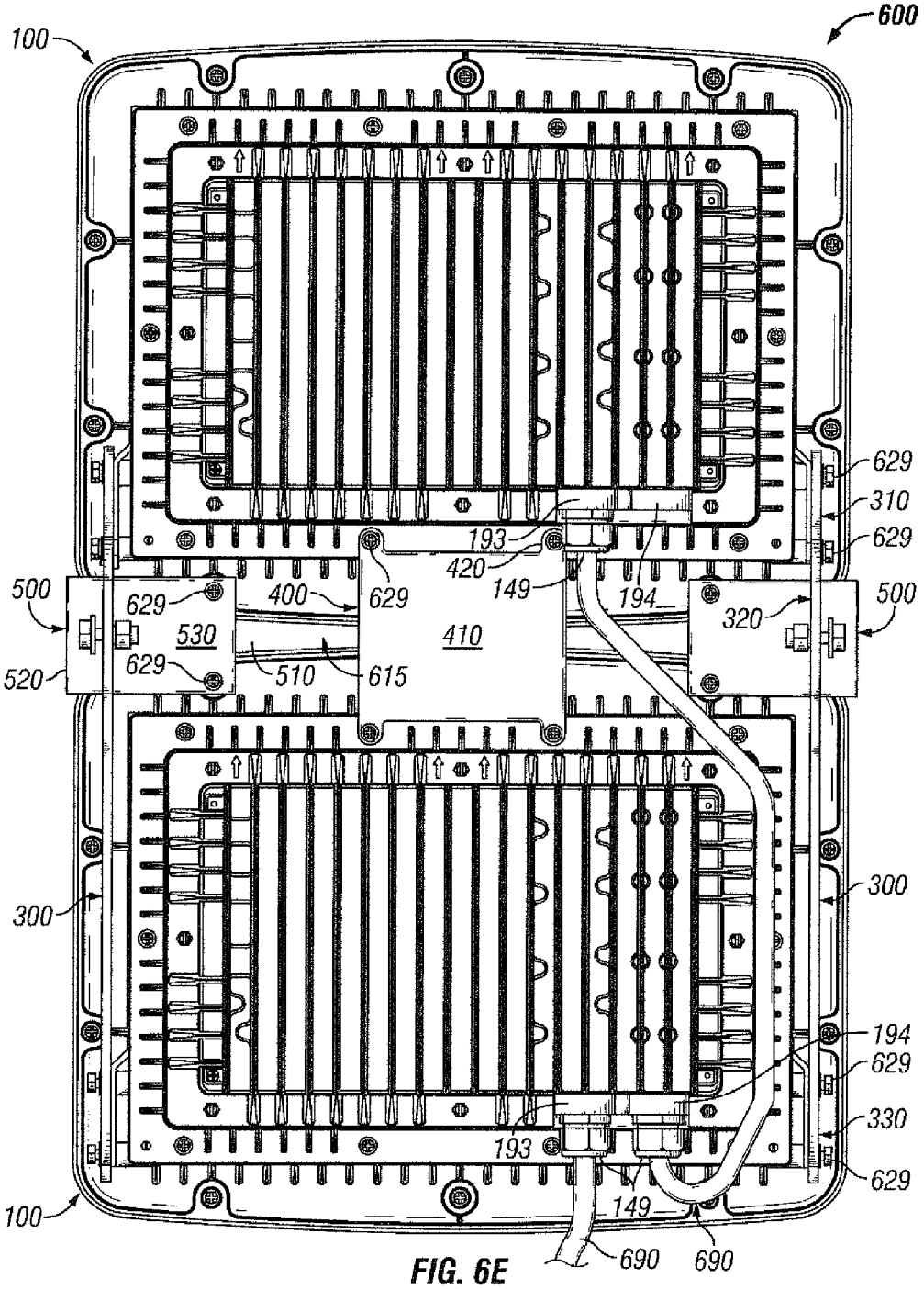

FIGS. 6A-6E show various views of a light fixture 600 in which one or more example embodiments may be implemented. Specifically, FIG. 6A shows a front perspective view of the light fixture 600. FIG. 6B shows a bottom view of the light fixture 600. FIG. 6C shows a side view of the light fixture 600. FIG. 6D shows a front view of the light fixture 600. FIG. 6E shows a rear view of the light fixture 600 (without the optional mounting assembly 680). In one or more embodiments, one or more of the components shown in FIGS. 6A-6E may be omitted, repeated, and/or substituted. Accordingly, embodiments of a light fixture using assembly systems should not be considered limited to the specific arrangements of components shown in FIGS. 6A-6E.

Referring to FIGS. 1A-6E, the light fixture 600 can include two or more light modules 100, one or more side brackets 300, one or more rear brackets 400, one or more center interfaces 500, one or more bridge and/or power cables 690, and the optional mounting assembly 680. While the example light fixture 600 is shown with two light modules 100 stacked vertically, a light fixture using example assembly systems can include more than two light modules 100 and/or can be oriented in any other way (e.g., horizontally (side-by-side), diagonally, randomly) with respect to each other. In such a case, one or more sides 111 having one or more coupling features 107 can be located on a top side, a bottom side, a left side, a right side, a front side, and/or a rear side.

In this case, the example assembly system includes two side brackets 300, with one disposed on each side 111 of the two light modules 100, which are stacked vertically with respect to each other. Each side bracket 300 is shaped and sized substantially the same relative to each other. In this example, the top portion 310 of each side bracket is mechanically coupled to a side 111 (in this case, toward the bottom) of the top light module 100, and the bottom portion 330 is mechanically coupled to a side 111 (in this case, toward the bottom) of the bottom light module 100.

As explained above, in certain example embodiments, middle portion 320 of the side bracket 300 can be mechanically coupled to one or more components of the light fixture 600. An example of such a component is the mounting assembly 680. The mounting assembly 680 can include one or more coupling features (hidden from view by fastening devices 688). Each coupling feature can be of the mounting assembly 680 can be disposed on a yoke bracket 686 of the bracket 682 of the mounting assembly 680. The coupling features of the mounting assembly 680 may be configured in any manner appropriate to receive and couple to the coupling features 340 of the side bracket 300, the coupling features 107 on the side 111 of a light module 100, and/or some other component of the light fixture 600. For example, as shown in FIGS. 6A-6D, the coupling features of the mounting assembly 680 may include one or more apertures for receiving fastening devices 688 (e.g., bolts) to couple the mounting assembly 680 to the middle portion 320 of the side bracket 300 and to a light module 100.

The yoke bracket 686 may include one or more features (e.g., slots) that allow a user to rotate, tilt, swivel, or otherwise move the light generated by the light fixture 600 in a particular vertical direction and/or angled position. For example, the yoke bracket 686 in FIGS. 6A-6D allow the light generated by the light fixture 600 to be directed at any point within a 180° arc. There may be more than one yoke bracket 686 for the mounting assembly 680. The mounting bracket 682 may be coupled to the yoke bracket 686. The mounting bracket 682 may be coupled to an external feature (e.g., a pole, a side of a building) to secure the light fixture 600 in a fixed or relative position. The mounting bracket 682 may be coupled to one or more such external features in one or more of a number of ways, including but not limited to fastening devices (e.g., bolts) that traverse apertures in the mounting bracket 682. The mounting assembly 680 may be made of any suitable material, including metal (e.g., alloy, stainless steel), plastic, some other material, or any combination thereof. The mounting assembly 680 may be made of the same or a different material as the other components of the light fixture 600.

The example light fixture 600 also includes one rear bracket 400 and one center interface 500. The rear bracket 400 is rectangular in shape, with a coupling extension 420 disposed in each corner of the main body 410. The top two coupling extensions 420 are mechanically coupled to a back side of the top light module 100, and the bottom two coupling extensions 420 are mechanically coupled to a back side of the bottom light module 100. The center interface 500 in this case has two side portions 520 and two rear portions 530, where two coupling features 540 (in this case, apertures) are disposed on each rear portion 530. The top coupling feature 540 of each rear portion 530 is mechanically coupled to back side of the top light module 100, and the bottom coupling feature 540 of each rear portion 530 is mechanically coupled to back side of the bottom light module 100. Each rear portion 530 is positioned (disposed) within the relief feature 350 of each side bracket 300. The front portion 510 of the center interface 500 has a height sufficient to cover the gap 615 that exists between two or more adjacent light modules 100.

The example assembly system of FIGS. 6A-6E also includes a bridge cable 690 and a power cable 690. The bridge cable 690 and the power cable 690 are substantially the same as each other, except for the connection points made by each. With respect to the bridge cable 690, one end of the bridge cable 690 is mechanically coupled to a cable gland 149 at electrical receiver 193 and is electrically coupled to the power source 260 of the top light module 100. The other end of the bridge cable 690 is mechanically coupled to a cable gland 149 at electrical receiver 194 and is electrically coupled to the power source 260 of the bottom light module 100. With respect to the power cable 690, one end of the power cable 690 is mechanically coupled to a cable gland 149 at electrical receiver 193 and is electrically coupled to the power source 260 of the bottom light module 100. The other end of the power cable 690 (not shown in FIG. 6E) is mechanically coupled to a power supply (e.g., another light module or fixture, a battery, a wall outlet).

Example embodiments provide for light fixtures having two or more light modules, where each light module has its own power source. The light fixtures using example assembly systems can have various shapes and sizes. The light modules of example light fixtures can be the same as or different from each other. The light modules of example light fixtures can be fixed or adjustable relative to each other. Example embodiments of the light fixtures described herein are designed to meet one or more of a number of standards and/or regulations to be used in a variety of conditions.

Although the inventions are described with reference to preferred embodiments, it should be appreciated by those skilled in the art that various modifications are well within the scope of the invention. From the foregoing, it will be appreciated that embodiments of the light fixtures using example assembly systems overcome the limitations of the prior art. Those skilled in the art will appreciate that light fixtures using example assembly systems are not limited to any specifically discussed application and that the embodiments described herein are illustrative and not restrictive. From the description of the example embodiments, equivalents of the elements shown therein will suggest themselves to those skilled in the art, and ways of constructing other embodiments of the light fixtures using example assembly systems will suggest themselves to practitioners of the art. Therefore, the scope of the light fixtures using example assembly systems is not limited herein.

What is claimed is:

1. A light fixture, comprising:

a first light module comprising:

at least one first side coupling feature disposed on a first side of the first light module;

at least one second side coupling feature disposed on a second side of the first light module, wherein the second side is opposite the first side; and at least one first rear coupling feature disposed on a first rear of the first light module, wherein the first rear is positioned adjacent to and in between the first side and the second side;

a second light module comprising:

at least one third side coupling feature disposed on a third side of the second light module;

at least one fourth side coupling feature disposed on a fourth side of the second light module, wherein the fourth side is opposite the third side; and at least one second rear coupling feature disposed on a second rear of the second light module, wherein the second rear is positioned adjacent to and in between the third side and the fourth side;

at least one first side bracket comprising a first portion and a second portion, wherein the first portion mechanically couples to the at least one first side coupling feature disposed on the first side of the first light module, and wherein the second portion mechanically couples to the at least one third side coupling feature disposed on the third side of the second light module;

at least one second side bracket comprising a third portion and a fourth portion, wherein the third portion mechanically couples to the at least one second side coupling feature disposed on the second side of the first light module, and wherein the fourth portion mechanically couples to the at least one fourth side coupling feature disposed on the fourth side of the second light module;

at least one first rear bracket comprising a fifth portion and a sixth portion, wherein the fifth portion mechanically couples to the at least one first rear coupling feature disposed on the first rear of the first light module, and wherein the sixth portion mechanically couples to the at least one second rear coupling feature disposed on the second rear of the second light module; and a center interface disposed over a first front portion of the first light module, a second front portion of the second light module, and a gap between the first light module and the second light module, wherein the center interface is disposed within a first relief feature of the at least one first side bracket and a second relief feature of the at least one second side bracket, wherein the first relief feature traverses at least part of a first length of the at least one first side bracket, and wherein the second relief feature traverses at least part of a second length of the at least one second side bracket.

2. The light fixture of claim 1, further comprising:

a bridge cable comprising a first end and a second end, wherein the first end is disposed in a first electrical receiver of the first light module and electrically coupled to a first power source of the first light module, and wherein the second end is disposed in a second electrical receiver of the second light module and electrically coupled to a second power source of the second light module.

3. The light fixture of claim 2, further comprising:

a power cable comprising a third end and a fourth end, wherein the third end is disposed in a third electrical receiver of the first light module and electrically coupled to the first power source of the first light module, and wherein the fourth end is electrically coupled to a power supply.

4. The light fixture of claim 1, wherein the at least one first side bracket further comprises a seventh portion, wherein the seventh portion comprises a mounting assembly coupling feature that mechanically couples to a mounting assembly.

5. The light fixture of claim 4, wherein the mounting assembly mechanically couples to the seventh portion of the at least one first side bracket in one of a plurality of positions between a yoke bracket and the seventh portion.

6. The light fixture of claim 1, wherein the center interface is mechanically coupled to the first rear of the first light module and to the second rear of the second light module.

7. The light fixture of claim 6, wherein the center interface comprises a first end and a second end, wherein the first end is mechanically coupled to at least one third rear coupling feature disposed in the first rear of the first light module and at least one fourth rear coupling feature disposed in the second rear of the second light module, and wherein the second end is mechanically coupled to at least one fifth rear coupling feature disposed in the first rear of the first light module and at least one sixth rear coupling feature disposed in the second rear of the second light module.

8. The light fixture of claim 1, wherein the first portion and the second portion of the at least one first side bracket are substantially coplanar with each other.

9. The light fixture of claim 1, wherein the first portion and the second portion of the at least one first side bracket form an angle relative to each other.

10. The light fixture of claim 9, wherein the angle is adjustable.

11. The light fixture of claim 1, wherein the at least one first side coupling feature comprises a plurality of first side coupling features disposed along the first side of the first light fixture, wherein the at least one first side bracket mechanically couples to the plurality of first side coupling features.

12. The light fixture of claim 1, further comprising:

at least one first fastening device that couples to the at least one first side coupling feature of the first light module and to the first portion of the at least one first side bracket; and at least one second fastening device that couples to the at least one third side coupling feature of the second light module and to the second portion of the at least one first side bracket.

13. An assembly system for a light fixture, comprising:

at least one first side bracket comprising a first portion and a second portion, wherein the first portion is configured to mechanically couple to at least one first side coupling feature disposed on a first side of a first light module, and wherein the second portion is configured to mechanically couple to at least one second side coupling feature disposed on a second side of a second light module;

at least one second side bracket comprising a third portion and a fourth portion, wherein the third portion is configured to mechanically couple to at least one third side coupling feature disposed on a second side of a first light module, and wherein the fourth portion is configured to mechanically couple to at least one fourth side coupling feature disposed on a fourth side of a second light module;

at least one first rear bracket comprising a fifth portion and a sixth portion, wherein the fifth portion mechanically couples to at least one first rear coupling feature disposed on a first rear of the first light module, and wherein the sixth portion mechanically couples to at least one second rear coupling feature disposed on a second rear of the second light module; and a center interface that is configured to be disposed over a first front portion of the first light module, a second front portion of the second light module, and a gap between the first light module and the second light module when the first light module and the second light module are mechanically coupled to the at least one first side bracket and the at least one second side bracket, wherein the first side of the first light module is opposite the second side of the first light module, wherein the first rear is positioned adjacent to and in between the first side and the second side, wherein the third side of the second light module is opposite the fourth side of the second light module, and wherein the second rear is positioned adjacent to and in between the third side and the fourth side, and wherein the center interface is disposed within a relief feature of the at least one first side bracket, wherein the relief feature traverses at least part of a length of the at least one first side bracket.

14. The assembly system of claim 13, wherein the center interface is configured to mechanically couple to the first rear of the first light module and to the second rear of the second light module.

15. The assembly system of claim 14, wherein the center interface comprises a first end and a second end, wherein the first end is mechanically coupled to at least one third rear coupling feature disposed in the first rear of the first light module and at least one fourth rear coupling feature disposed in the second rear of the second light module, and wherein the second end is mechanically coupled to at least one fifth rear coupling feature disposed in the first rear of the first light module and at least one sixth rear coupling feature disposed in the second rear of the second light module.

16. The light fixture of claim 12, wherein the first portion of the at least one first side bracket comprises at least one first aperture through which the at least one first fastening device is disposed, and wherein the second portion of the at least one first side bracket comprises at least one second aperture through which the at least one second fastening device is disposed.

* * * * *